United States Patent [19]

Baehr

[11] 4,150,083

[45] Apr. 17, 1979

[54] CONTOURING GYPSUM ARTICLES

[75] Inventor: Donald O. Baehr, Arlington Heights, Ill.

[73] Assignee: United States Gypsum Company, Chicago, Ill.

[21] Appl. No.: 665,662

[22] Filed: Mar. 10, 1976

[51] Int. Cl.[2] ..... B28B 1/52

[52] U.S. Cl. ..... 264/256; 52/DIG. 8; 249/172; 264/295; 264/309; 264/316

[58] Field of Search ..... 264/295, 296, 309, 87, 264/316, 256; 249/170–172; 52/DIG. 8

[56] References Cited

U.S. PATENT DOCUMENTS

| | | | |
|---|---|---|---|
| 2,074,463 | 3/1937 | Davis | 52/DIG. 8 |
| 2,655,196 | 10/1953 | Magnani | 264/316 |
| 3,289,371 | 12/1966 | Pearson | 264/309 X |
| 3,890,415 | 6/1975 | Hull | 52/DIG. 8 |
| 3,974,024 | 8/1976 | Yano | 264/42 X |

*Primary Examiner*—Thomas P. Pavelko

*Attorney, Agent, or Firm*—Kenneth E. Roberts; Robert H. Robinson; Samuel Kurlandsky

[57] ABSTRACT

An improved process for forming cast articles of plaster reinforced with fibers is disclosed wherein low consistency plaster slurries that include a fluidizing agent and fibrous reinforcing materials are co-sprayed onto a sectionalized casting bed having a flexible membrane section connecting rigid sheet forming bed portions; allowed to stand in a horizontal position through initial stiffening; and then before the slurry has set, the sectionalized casting bed is reformed so as to produce a contoured shape to the gypsum cement sheet.

10 Claims, 3 Drawing Figures

CONTOURING GYPSUM ARTICLES

FIELD OF THE INVENTION

This invention relates to fibrous reinforced plaster compositions and to methods of forming such articles and; more particularly, to an improved process for forming cast articles of plaster reinforced with fibrous materials wherein larger amounts than heretofore practical of fibrous reinforcing material may be included and whereby the cast composition after initial stiffening and before set may be reformed into contour shapes after intially being cast into flat sheet form. In the preparation of irregularly shaped plaster products containing fibrous reinforcement, the basic problem is to obtain a distribution of the fibers in the plaster composition, since the fibers have a tendency to tangle and form lumps or balls during mixing. As a result, one does not as a practical matter obtain more than a few percent incorporation of glass fibers into slurry cast gypsum formulations.

For some time now, it has been known generally to incorporate fibrous materials, such as cellulosic fibers and glass fibers, for reinforcement into a cementitious slurry such as a gypsum slurry. Particularly with the use of glass fiber, as a practical matter, it becomes increasingly more difficult to accomplish the integral, intimate and thorough inter-mixing necessary to provide a reinforcement to the cementitious matrix as the amount of glass fiber being incorporated increases. Apparently, the amounts of glass fiber are limited to about 2–3% by weight and about 1.5–2% by volume that can be directly mixed with a plaster slurry and thoroughly dispersed in the slurry by suitable mixers; and even the resultant material here suffers considerable ultimate strength losses in comparison to other means of incorporation and other amounts of fiber being incorporated. Such other means would of course include the sprinkling upon the surface of already cast slurries additional quantities of either long continuous rovings or short chopped fiber bundles and then impressing them into the surface of the slurry; and the initial placing of continuous parallel strands in the base of the casting mold before addition of the slurry. These methods suffer the limitation of confining the shape of the finally cast article to that of a smooth, flat panel or board or the like, and such methods are not suitable for the casting of irregularly shaped articles.

Another distinct problem in the area is that of imparting shape to plaster materials being cast, that is of imparting a face configuration to thin panel sections of gypsum. Ordinarily if an irregular shape is desired, an appropriate mold having the final configuration is utilized i.e. if a "U"-shape beam or channel member is desired appropriately shaped male and female enclosing molds to give the desired figuration are used. Also it has not been previously thought possible to change the position of a horizontal panel because the slurry would run down a vertically disposed mold.

DESCRIPTION OF THE PRIOR ART

The art appears replete with numerous examples of incorporating various fibrous materials into gypsum cement slurries for reinforcement purposes. For example U.S. Pat. No. 2,451,446 discloses a blending of relatively large quantities of fibers into a light weight and low strength gypsum composition; and the formation via fiber-emulsion mixture technique of flat cast foamed sheet items such as gypsum board. That patent also describes a technique of using little excess of water while avoiding suction to remove excess water when forming the desired shape. Still the shape of the mold into which the slurry is cast remains unchanged once the slurry is charged into the mold. Other representative patents for the inclusion of fibers into gypsum slurry include U.S. Pat. Nos. 2,970,127; 2,664,406; 2,981,038; 3,289,371; 3,369,929; 3,369,929; 3,839,059; and British Pat. No. 1,204,541. That latter patent represents a common technique to the stuccoing art whereby large amounts of reinforcing glass fibers are incorporated using considerable excesses of water beyond the normal consistency of the particular plaster and by following the casting with a suction dewatering to remove excess water beyond the theoretical water necessary for hydration for development of high strength casts; and further does disclose spraying the fibers and aqueous slurry onto a mold but without any apparent capability of reshaping the mold configuration after spray application of the materials.

The inclusion of fibers into a gypsum slurry should be distinguished from incorporation of a cementitious material into a fibrous mat; since the latter is merely a sheet impregnated with plaster and will hold its shape while the former still retains its slurry character meaning that in its plastic state it is deformable in any direction without rupture and thus will not possess the integrity characteristic of a sheet. In many cases a wet sheet is capable of bending without breaking. For example U.S. Pat. No. 3,764,252 discloses an apparatus for forming a corregated asbestos cement sheet which in operation accepts a flat wet asbestos cement sheet on a flat table having separate flexible membrane sections which are urged together in an accordian fashion so as to produce a desired contour bending of the wet asbestos cement sheet. While it would appear that such technique would be applicable to bending other wet sheets, one ordinarily skilled in the art would not expect a wet slurry would be capable of being bent and then holding its bent form without flowing or sagging while wet. In the plaster art, slurries have all routinely been poured into an already formed mold and allowed to adapt to the configuration of the rigid mold and then cured without any bending of the wet structure. It is also well established that generally any interruption of a gypsum slurry after hydration or initial set has started generally results in an ultimate loss of strength in the resultant set cast article.

SUMMARY OF THE INVENTION

It is therefore an object and advantage of the present invention to provide a process for manufacturing a contoured gypsum product wherein, before the setting of a gypsum slurry, the slurry is reformed.

Another object and advantage is the provision of means for manufacturing a contour gypsum product from a gypsum slurry containing larger quantities of reinforcing fibrous materials than heretofore practical and without suction dewatering being necessitated.

Still another object and advantage is the provision of means for molding a gypsum slurry after initial stiffening and before setting of the composition into a high strength thin contoured product.

The fulfillment of the above and other objects and advantages of the present invention are accomplished basically by the steps of forming a slurry comprising a low consistency calcium sulfate hemihydrate, dispersing agent and water; spraying said slurry onto a sectionalized substantially horizontal casting bed which comprises at least two separate rigid casting bed supports and at least one flexible membrane connected to said rigid casting bed supports and bridging between said supports; co-spraying an amount of chopped fiber strands into said slurry; allowing initial stiffening of the sprayed slurry and fiber; and before setting of the slurry, reforming the spaced relationship of the rigid bed supports to produce a contoured shape to the setting gypsum composition. The accomplishment of the above was a rather surprising discovery for one would ordinarily believe that attempts to bend the cast gypsum product after initial stiffening would result in the material flowing and sagging from the membrane and also result in ultimate strength losses via cracking and splitting of the product. Further it was surprising that such large quantities of fibrous materials could be incorporated without the necessity of suction dewatering as called for in the British Pat. No. 1,204,541.

BRIEF DESCRIPTION OF THE DRAWINGS

The invention will be more readily understood by reference to the ensuing detailed description of preferred embodiments and reference to the accompanying drawing in which.

DETAILED DESCRIPTION OF THE PREFERRED EMBODIMENTS

Figure 1:
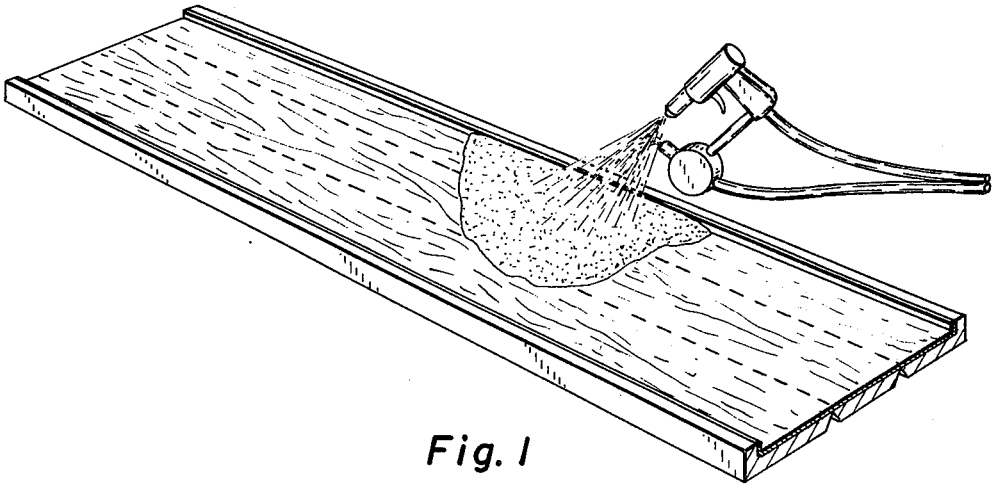
FIG. 1 is a perspective view of the sectionalized casting bed on which is being sprayed simultaneously the gypsum slurry and chopped glass fiber strands.

In a highly optimized preferred embodiment, an aqueous slurry was formed to contain about 87% by weight of the solids being alpha calcium sulfate hemihydrate, a small amount less than about 1% by weight of LOMAR D dispersing agent, about 5% by weight of a Portland cement, a small amount of plaster accelerators and retarders, and about 25–40 parts of water based on the weight of solids. The gypsum slurry was co-sprayed with a glass fiber as shown more particularly in FIG. 1. The primary spray gun sprayed the gypsum slurry; and a vane chopper attached to the spray gun, and fed by a separate air hose and glass rovings feed lines, chopped and sprayed glass fiber into the pattern of the sprayed gypsum slurry. The casting bed comprised three rigid panel supports that had been embossed with a wood grain pattern; the rigid panels being connected by an embossed polymer overlay membrane that was about $\frac{1}{8}$" thick and about 13 inches wide by 4–8 feet long. Spraying was continued until the flat wood-grain molds had been filled with the slurry to a depth of about 0.1 inch of gypsum slurry containing 4% by volume and 5.5% by weight chopped glass fiber strands. After the spray composition had remained for sufficient time for initial stiffening, the outer side panels were urged upwardly into a vertical position thereby shaping the cast slurry before set to form a rectangular channel in the shape and appearance of a hollow wood beam. Details were sharply reproduced and a weight of 0.98 lbs. per linear foot was obtained in the shaped product which did not evidence any cracking at the shaping lines or loss of strength, as shown more particularly in FIGS. 2 and 3.

The plaster slurries for use in the present invention may be of any gypsum cement composition, provided the amount of solids and water which will be mixed together to form the composition is such to give an easily pumpable and fluid aqueous slurry that is fluid enough to be sprayed. Thus ordinary plaster of Paris, gypsum board stuccos and casting plaster in general may be used. The aqueous slurries of such materials will be fluid enough for spraying at normal consistencies of about 60–85 cubic centimeters of water per 100 grams of solid materials, although the specific consistency will vary depending upon the particular calcium sulfate hemihydrate composition utilized and the fluidity necessary to be maintained will depend principally upon the particular spray equipment being used. It is preferred to use calcium sulfate hemihydrates of the type commonly called "alpha gypsum" for strength purposes of the cast sheet. Such materials are commonly available; and typical methods of producing them are disclosed in U.S. Pat. Nos. 1,901,051 and 3,423,172. Such materials will be imminently sprayable when formulated to a normal consistency of about 25 to about 40 cc. of water per 100 grams of solid materials. When employing the preferred alpha gypsum and aqueous slurries for use in the present invention it is also preferred that a dispersing agent be included in the formulation to assist in obtaining readily pumpable fluidity. The particular dispersing agent is not critical, and any that are of the well known ingredients may be used including, for example, various lignosulfonates; guar gum; arabic gum; and various condensates of napthalene sulfonic acids and an aldehyde, such as those commercially available under the brand LOMAR D.

The fibrous materials for use in the present invention may be any of the natural or synthetic fiber materials available, such as glass fiber, with strands or rovings cut or chopped to discrete lengths of about $\frac{1}{4}$ inch to about 2 inches. Any of the glass fibers are imminently suitable and preferred for reasons of availability and ease of usage, and such materials may be of any choppable fiber, uncoated or coated with any available coupling agent, sizing, binding, slip or lubricating agent and the like. For ease of handling, it is preferred to utilize continuous rovings of fiber, supplying the roving to a chopping apparatus to break the continuous strand up into discrete strands, fibriles or filaments of the appropriate length and then spray the fibers into the plaster slurry. Fiber diameter is not critical in any way.

Figure 2:
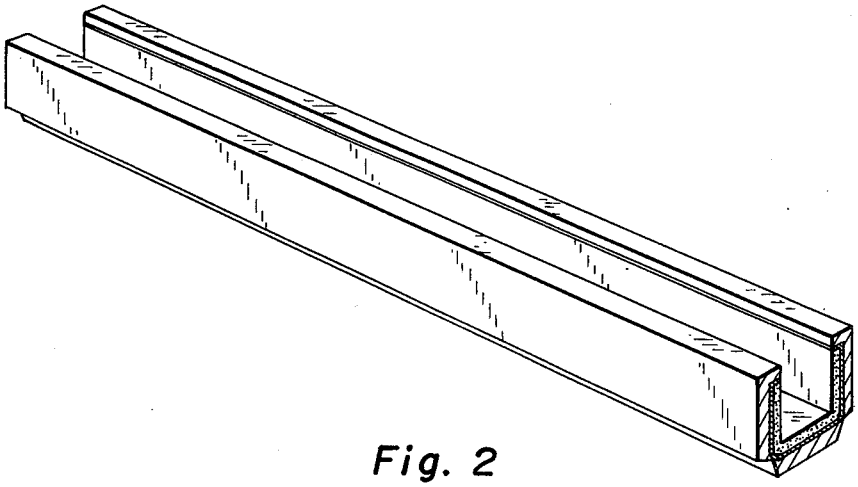
FIG. 2 is a perspective view of a contoured gypsum product manufactured according to the invention.

While it is preferred that a suitable fiber, such as glass fibers, be chopped and co-sprayed into the spray pattern of the aqueous plaster slurry, as more particularly shown in FIG. 1, it is also satisfactory to provide separate spray guns spraying the aqueous plaster slurry and the glass fiber. Further it would be suitable to co-mingle the aqueous plaster slurry and the fibers by suitable feed and mixing means and then co-spraying them from a unitary nozzle. In addition it is imminently suitable in the practice of the present invention to spray onto the casting bed separate patterns of the fibrous material and the aqueous plaster slurry. Thus separate spray guns may be positioned to spray onto the casting bed alternating layers of aqueous plaster slurry and fibrous material. This could be by means of two separate spray guns providing either patterns intermingled or alternating onto the casting bed by simultaneous or alternating spraying of the aqueous plaster slurry and the discrete fibrous material. It does not seem to be important to the present invention how the fibrous materials is chopped or sprayed, or the rate or application or alternating of separate applications of the fibrous material and the aqueous plaster slurries so long as the building-up of the gypsum sheet evidences a fairly uniform distribution of the discrete fibrous materials in amounts of about 2–12% by weight and preferably about 4–10% by weight throughout the gypsum cement sheet. As the dry fiber is added to the aqueous slurry, either as the slurry is being placed or after the slurry has been placed, the dry fiber absorbs some of the water of the slurry causing an initial stiffening of the aqueous slurry-fiber composite.

The time for further stiffening of the applied plaster-fibrous composition will vary with the normal time of set of the different plaster materials suitable in forming the gypsum composition. This may readily be determined by taking a portion of the particular plaster slurry as a test sample and timing the ordinary set time as determined by normal test methods such as the Vicat needle set and by observing the stiffening times before set.

Figure 3:
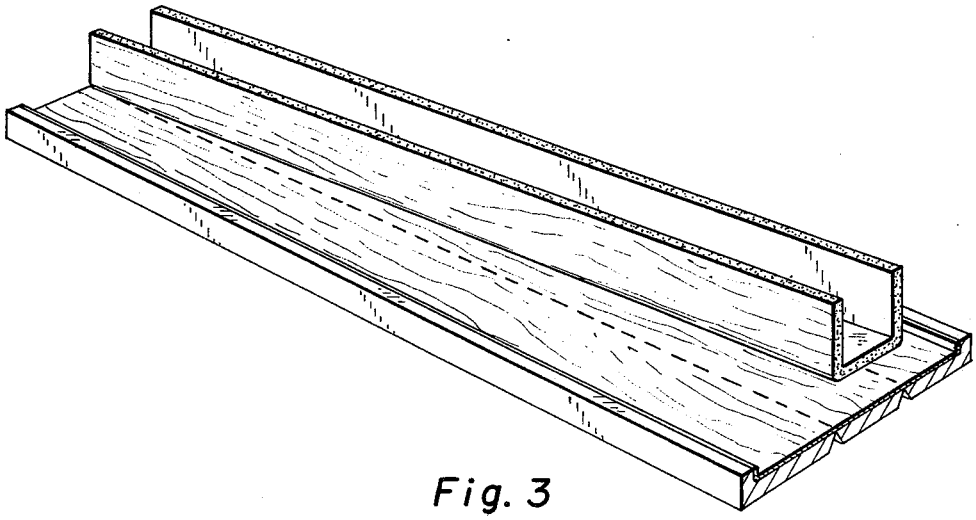
FIG. 3 is a perspective view of the product of FIG. 2 being removed from the casting bed of FIG. 1.

The flexible membrane, as more particularly shown on FIGS. 1 and 3, may be of any flexible polymeric materials of a resilient nature; and thus may be of a rubbery material such as neoprene and the like or polyvinylchloride or polyurethane as being preferred thin flexible membrane film materials. Further, the surface of said membrane material may be optionally etched, carved or impressed with any desired indicia or pattern, such as a wood-grained pattern and configuration and the like. The rigid casting bed supports may be of any suitable material such as wood, metal, or rigid plastic depending upon the size and dimensions of the contoured sheet to be obtained. For simple configurations and of small sized casts, it is possible to have both the more rigid bed supports and the more flexible membrane composed of a semi-rigid polymer and they may be formed in a unitary construction by injection molding or the like. For long and generally simple contoured sheets such as a U-shaped imitation wood beam configuration, wood or metal is preferred for the rigid support and a 1/32 inch to ½ inch polymer membrane is preferred for the flexible support for supporting strength, resilience and economy. In addition, the gap or distance from one rigid support member to another rigid support member is highly variable depending upon the amount of contour, bend or angle desired for the final curved, angular or irregular figure shape that the sheet is to take and the nature and thickness of the resilient flexible membrane. For example, in the case of a simple hollow shelled U-shaped channel configuration, the gap may be narrow and as shown more particularly in FIGS. 1 and 3. Depending upon the dimensions of the rigid casting bed supports, the ultimate contour, and the composition and thickness of the flexible membrane, when the gap is substantially increased it may be desirable to provide further optional additional support across the gap by, for instance, adding a piano-hinge or like pivoting means and support means underneath the flexible membrane and bridging the gap between the rigid casting bed supports. Increased membrane thickness, rigidity or support might be desirable where large curves, or broad turns or sweeps are desired in the deflection configuration, as for example when a corregation style of convolution is desired in the contouring.

It will be apparent to those skilled in the art from the preceeding description, that certain changes may be made in the above described apparatus and process without departing from the spirit and scope of the invention. Thus for example, although the invention has been illustrated in preferred form for forming a hollow U-shaped configuration such as for an artificial imitation wooden ceiling beam, other contours are intended such as contouring the cement sheet shape into box channels for use as duct work in construction, Z-shape return air ducts and outside wrappers for fireproofing columns; arciform ceiling coffers and light troughs; rectalinear tray forms to hold poured concrete bar joists and the like, corregating undulations, sweeps and convolutions and other shapes to fit particular contours or outlines of a curving, angular or irregular configuration. Similarly, known additives may be included in customary amounts to modify various properties of the gypsum-fibrous composition. Thus, organic and inorganic supplemental cementitious materials such as a Portland cement or a polymeric resin may be introduced to the plaster cementitious materials and slip agents and coupling agents for the fiber material may be incorporating. In some instances it may be desired that a minor proportion of a calcium sulfate hemihydrate accelerator, or retarder, or mixtures thereof, be present in order to vary the setting time of the cementitious mass. Similarly, other dispersing or fluidizing agents for calcium sulfate hemihydrate may be used in place of the one specified herein above with substantially equivalent results, and the amount of such dispersing agent may vary widely depending on the particular one used. In addition, well known mold release agents may be incorporated onto the casting bed before depositing the plaster slurry-fiber composite for ease of separating the set gypsum cast sheet from the casting bed.

Thus, in summary it is intended that the descriptive matter above shall be interpretive as illustrative and in no way limiting.

What is claimed is:

1. A process for manufacturing a countoured gypsum sheet comprising:

(a) forming an aqueous slurry of calcium sulfate hemihydrate sufficiently fluid as to be sprayable;

(b) spraying said slurry onto a substantially horizontal, sectionalized casting bed which comprises (1) at least two separate, rigid casting bed surfaces, (2) and a flexible membrane covering said rigid casting bed surfaces and bridging between said bed surfaces;

(c) spraying onto the aqueous slurry an amount of discrete fibrous strands comprising about 2 to about 12% by weight of the total gypsum composition;

(d) and, after initial stiffening of the sprayed composition and before setting of the gypsum composition, reforming the spaced relationship of the rigid bed surfaces to produce a contoured shape to the gypsum sheet.

2. The process of claim 1 wherein the spraying of the aqueous slurry co-mingles with the spraying of the fiber strands, and the gypsum-fiber composite is co-sprayed onto the casting bed.

3. The process of claim 1 wherein the spraying of the aqueous slurry and the spraying of the fiber strands are separate from each other, and the spray patterns are separately overlayed on the casting bed to provide a layered gypsum-fiber composite sheet.

4. The process of claim 1 in which the fiber strands comprise chopped glass fibers having lengths of about ¼ inch to about 2 inches.

5. The process of claim 1 in which the aqueous slurry includes beta calcium sulfate hemihydrate.

6. The process of claim 1 in which the aqueous slurry includes alpha gypsum.

7. The process of claim 1 in which the casting bed includes at least one hinge member between the rigid casting bed surfaces.

8. The process of claim 1 in which the aqueous slurry comprises about 87% by weight of the solids being alpha calcium sulfate hemihydrate, a small amount of dispersing agent and about 25–40 parts of water based on the weight of solids; and the gypsum sheet contains about 4–10% by weight of chopped glass fiber strands having a length of about ¼ to about 2 inches.

9. A process for manufacturing a U-shaped channel member from a gypsum sheet comprising:

(a) forming a sprayable, fluid plaster aqueous slurry;

(b) spraying said slurry and fiber onto a substantially horizontal, sectionalized casting bed which comprises (1) three separate rigid casting bed surfaces (2) and a flexible membrane covering said rigid casting bed surfaces and bridging between said bed surfaces; the fiber being sprayed in an amount of discrete fiber strands of about 2–12% by weight of the gypsum sheet;

(c) and, after initial stiffening of the gypsum-fiber composition and before setting of the plaster-fiber composition, reforming the spaced relationship of the substantially horizontal rigid bed surfaces to produce a U-shaped contour to the gypsum sheet.

10. The process of claim 9 in which the casting bed flexible membrane has a wood grain pattern and on reforming to a U-shaped contour the gypsum sheet has the appearance of a hollow wooden beam.

* * * * *